US005901476A

United States Patent [19]

Buonfiglio

[11] Patent Number: 5,901,476

[45] Date of Patent: May 11, 1999

[54] PLOW LIFT SYSTEM

[76] Inventor: Nick J. Buonfiglio, 120 Livingston St., Saugerties, N.Y. 12477

[21] Appl. No.: 08/883,298

[22] Filed: Jun. 26, 1997

[51] Int. Cl.[6] ..... E01H 5/04

[52] U.S. Cl. ..... 37/234; 37/236

[58] Field of Search ..... 37/234, 236, 348, 37/235, DIG. 19; 172/2, 3, 4, 7, 45, 810, 801, 805, 812, 828, 830, 831, 299; 414/699, 685

[56] References Cited

U.S. PATENT DOCUMENTS

| | | | |
|---|---|---|---|
| 3,585,319 | 6/1971 | Payerle et al. | 206/6 A |
| 4,028,820 | 6/1977 | Simonds, Jr. | 172/801 X |
| 4,353,177 | 10/1982 | Hoekstra | 37/234 |
| 4,535,847 | 8/1985 | Hasegawa et al. | 172/2 |
| 4,554,751 | 11/1985 | Nicolosi et al. | 37/234 |
| 4,807,375 | 2/1989 | Iraci | 37/236 |
| 4,999,935 | 3/1991 | Simi et al. | 37/236 |
| 5,473,306 | 12/1995 | Adell | 340/468 |

*Primary Examiner*—Thomas B. Will
*Assistant Examiner*—Robert Pezzuto

[57] ABSTRACT

A snow plow lift system in kit form to modify an existing manually actuated hydraulic snow plow control mounted on a vehicle for automatically lifting a snow plow when the vehicle is placed in reverse. The system uses a solenoid to actuate the hydraulic piston which raises the plow, the solenoid being energized by a back up light on the vehicle.

3 Claims, 2 Drawing Sheets

MECHANICAL DIAGRAM

MECHANICAL DIAGRAM

| | |
|---|---|
| SOL | SOLENOID |
| BR | BREAKER 20A |
| BLS | BACK-UP LIGHT SWITCH |
| BUL | BACK-UP LIGHT |
| OOS | ON-OFF SWITCH |
| LS | LIMIT SWITCH |
| REL | RELAY |
| BAT | BATTERY 12V |
| FS | FUSE 20A |

LEGEND

ELECTRICAL DIAGRAM

PLOW LIFT SYSTEM

BACKGROUND OF THE INVENTION

1. Field of the Invention

This invention relates to plows for removing snow and more particularly to a plow lift system for modifying a snow plow control so that the snow plow control will automatically raise the plow when the vehicle on which the plow is mounted is shifted into reverse and even more particularly to a snow plow lift system in kit form for modification of an existing manually-actuated hydraulic plow control including a solenoid energized by a rear back up light to activate the valve for raising the snow plow.

2. Prior Art and Objects.

Snow plows for attachment to vehicles, usually four-wheel drive vehicles, are widely used in areas where snow plowing is required. The snow plow may be raised or lowered and turned to the left and the right to place the snow to whichever side of the vehicle is desired. Snow plow controls are of two major types, namely those in which the hydraulic values are manually actuated and those where electrical controls are used to actuate the hydraulic units.

When plowing snow with a smaller vehicle, such as a four-wheel drive pick-up truck, rather than a massive highway plow, there is a need to back up repeatedly. On occasion, in plowing snow, it is desired to pull snow with the plow rather than push the snow but pushing snow is the primary operation.

When operating in limited space, such as a yard or parking lot, frequent back and forth moves are required. Most usually, the plow must be raised each time the vehicle backs up and forgetting to raise the plow can cause damage to the surface and the plow and most certainly results in lost effort. During long periods of operation, it is easy to forget to raise the plow. A control which automatically raises the plow when the vehicle is placed in reverse is very desirable. However, since on occasion, pulling snow backward is desired, it is important to be able to disable the automatic operation.

The Iraci Patent, U.S. Pat. No. 4,897,375 pertains to a system for raising a snow plow. The system taught by Iraci pertains to an electrically actuated control. Also, Iraci lowers the plow automatically when the vehicle is returned to forward motion. In plowing this may or may not be desired and by leaving the plow raised, until specifically lowered by the operator, the system must fail safely, if at all.

It is therefore an object of the present invention to provide an automatic system to raise a snow plow when the vehicle on which the plow is mounted is placed in reverse.

It is another object of the present invention to provide a plow lift system for raising a snow plow in which in the hydraulic system is actuated manually by the operator pushing and pulling a valve in a hydraulic manifold.

It is another object of the present invention to provide an economical plow lift system in kit form for readily converting a snow plow control to raise the plow automatically when the vehicle on which the plow is mounted is placed in reverse.

Other objects and advantages of the present invention will become apparent to those of ordinary skill in the art as the description thereof proceeds.

SUMMARY OF THE INVENTION

A snow plow lift system is provided for use with an existing manually actuated hydraulic control for a snow plow mounted on a vehicle so as automatically to raise the snow plow when the vehicle is placed in reverse. The vehicle must have a power source and have a rear back up light which comes on when the vehicle is put into reverse to back up. The existing plow control has a hydraulic manifold with valves that are withdrawn to actuate the hydraulic system, one of such valves actuates the hydraulic units to raise and lower the plow and which would, absent the plow lift system, be actuated by being manually pulled and pushed, The plow lift system is actuated electrically by a rear back up light and includes an on/off switch, a limit switch and a relay. The on/off switch, the limit switch and the relay are all connected in series to the back up light so that when the on/off switch and the limit switch are both closed and the back up light is actuated, by placing the shift lever of the vehicle in reverse, the solenoid is actuated. Upon actuation of the relay, the relay is closed and electrical power from the electrical power source passes through the relay to a solenoid. The solenoid has a solenoid arm and upon actuation of the solenoid, by supplying power to the solenoid through the relay, the solenoid arm is withdrawn into the solenoid. A pivot is secured to the vehicle and an actuator arm is mounted on the pivot. The actuator arm has two ends and is mounted on the pivot between the two ends so as to rotate on the pivot. One end of the actuator arm is connected to the solenoid arm to be rotated by the solenoid arm. The other end of the actuator is connected to the valve so as to rotate on the valve and is used to withdraw the valve from the hydraulic manifold. The withdrawing of the valve actuates the hydraulic unit though hydraulic conduits to raise the plow.

The limit switch is situated above the snow plow and in the course of upward travel of the snow plow so as to be contacted by the plow when the plow reaches its uppermost position. Upon being struck by the plow, the limit switch opens and the relay is de-energized thereby de-energizing the relay leaving the plow in the raised position until the valve is manually moved back into the manifold and the solenoid arm is withdrawn.

DESCRIPTION OF THE DRAWINGS

The invention may be more readily understood by referring to the accompanying drawings, in which.

DESCRIPTION OF THE PREFERRED EMBODIMENT

The invention provides a kit with which to modify a manually-actuated hydraulic control for lifting and lower a snow plow 11. The manually actuated hydraulic control also turns the snow plow 11 from side to side to force the snow being plowed from one side of the plow 11 to the other side of the plow 11.

Figure 1:
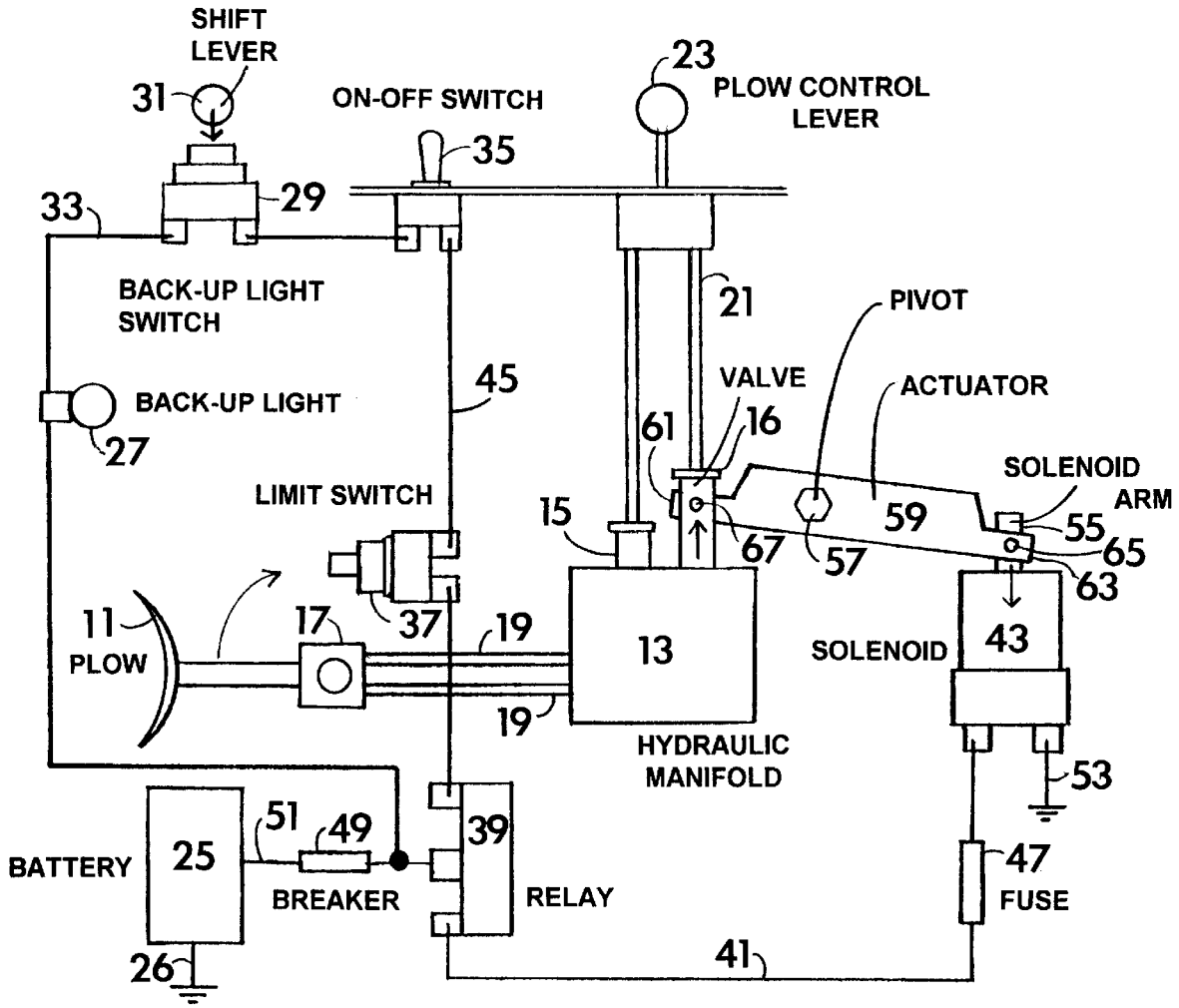
FIG. 1 is a schematic view of the plow lifting system showing primarily the mechanical components along with the electrical wiring connecting the mechanical components.
Figure 2:
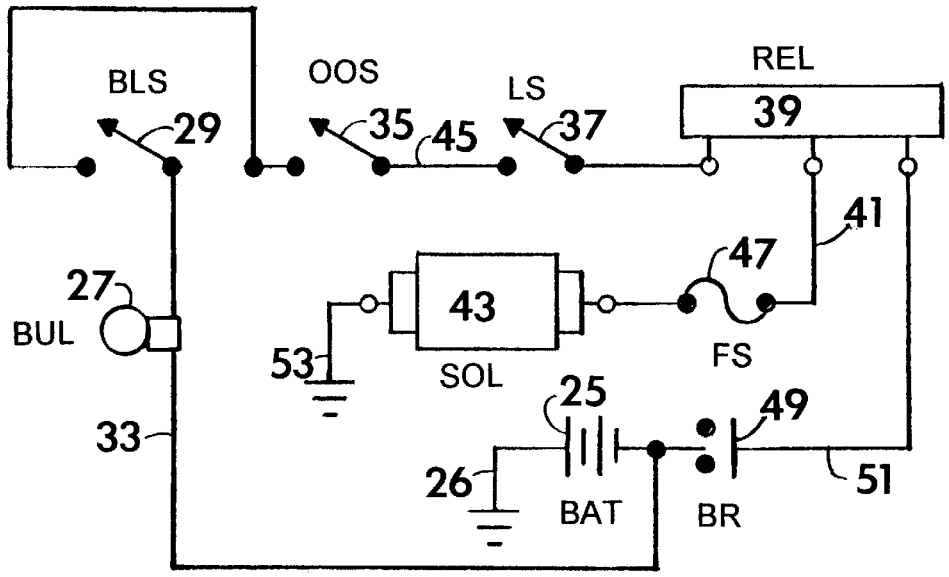
FIG. 2 is an schematic view of the electrical wiring for the plow lifting system with minimal mechanical components included.

Referring now to FIG. 1, a hydraulic manifold 13 is shown which is part of the plow control and which is present prior to the installation of the plow lift system. The hydraulic manifold 13 is indicative of the type of plow control for which this invention is applicable. A pair of valves 15,16 are shown mounted to slide in and out of the hydraulic manifold 13. Withdrawal of a either one or both of the valves opens the hydraulic manifold 13 to actuate hydraulic units 17 through hydraulic conduits 19 to move the plow 11 either up and down or left and right depending upon which of the valves 15,16 is selected. The valve 15 shown in FIG. 1, as being within the hydraulic manifold 13 is the valve 15 used to turn the plow 11 from left to right and the plow lift system does not involve that valve 15 and that area of the operation of the plow control. The valve 16, shown as extended out of the hydraulic manifold 13 is the valve 16 which actuates the raising and lowering of the plow 11 and is the valve 16 whose operation is, in part, controlled by the plow lift system. Without the plow lift system, both valves 15,16 would be actuated solely by the manual movement of a control rod 21 caused by the operator of the snow plow moving a plow control lever 23.

It, of course, should be clear that the plow control is mounted on a vehicle suitable for plowing such as a four-wheel drive pick-up truck. Such a vehicle will include a battery 25 which is maintained charged by an alternator (not shown). The battery 25 is grounded by a ground 26. It is also common place for such a vehicle to have a back up light 27, which is actuated by a back-up light switch 29. The back-up light 27 is a light mounted on the rear of the vehicle and is energized when the vehicle is placed in reverse by movement of the shift lever 31. Whether the vehicle has an automatic transmission or a manual transmission, makes no difference, as in either situation, the back up light 29 is energized when the vehicle is placed in reverse by movement of the shift lever 31.

The back-up light switch 29 that activates the back-up light 27 is energized by an electrical line 33 from the battery 25. When the vehicle is placed in reverse, by moving the shift lever 31. the back up light switch 29 is closed. An on-off switch 35 is used to deactivate the plow lift system. With the on-off switch 35 open, the entire plow lift system is deactivated and the plow control operates as if the plow lift system was not present. A limit switch 37, which is normally closed, is used to deactivate the plow lift system when the snow plow 11 is in its uppermost position. A relay 39 is used to open and close an electrical line 41 which activates a solenoid 43. An electrical line 45 connects the on-off switch 35, the limit switch 37 and the relay 39 in series. Thus, with the back-up light switch 29 closed and the on-off switch 35 closed and the limit switch 37 closed, the relay 39 is energized and thereby the relay 39 is closed. With the relay 39 closed, the solenoid 43 is activated by the electrical line 41 which has a fuse 47 in the electrical line 41 to protect against over loading of the solenoid 43. A breaker 49 is also located in an electrical line 51 between the battery 25 and the relay 39. The solenoid 43 has a ground connection 53 to complete the circuit back to the battery ground 26. The solenoid 43 has a solenoid arm 55 which can slide in and out of the solenoid 43 and is pulled into the solenoid 43 when the solenoid 43 is electrically activated.

A pivot 57 is secured to the vehicle. An actuator 59 is mounted on the pivot 57. The actuator 59 is an elongated bar having two ends 61,63 and is mounted on the pivot 57 between the two ends 61,63 so as to rotate on the pivot 57. One end 63 of the actuator 59 is connected to the solenoid arm 55 by means of a connection 65 which rotates. The other end 61 of the actuator 59 is connected to the valve 16 in the hydraulic manifold 13 also by a connector 67 which permits the actuator 59 to rotate on the valve. When the solenoid 43 is actuated and the solenoid arm 55 is pulled into the solenoid 43, the actuator 59 rotates on the pivot 57 so as to pull the valve 16 out of the hydraulic manifold 13 to open the hydraulic manifold 13 to actuate the hydraulic units 17 thereby raising the plow 11.

The limit switch 37 is situated above the plow 11 so as to be contacted by the plow 11 when the plow 11 reaches its most upper position. The plow 11, upon contacting the limit switch 37 opens the limit switch 37, thereby opening the electrical line 51 which supplies power to the relay 39 and thereby opens the relay 39 and de-energizes the solenoid 43 and stops the extending of the valve 16 from the hydraulic manifold 13. The valve 16, however, remains in its extended position until the value 16 is manually pushed back into the hydraulic manifold 13 by the operator moving the plow control lever 23.

It is to be understood that the drawings and description matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. A plow lift system for incorporation into and the modification of an existing snow plow control on a vehicle with a snow plow, the snow plow control having a hydraulic manifold with a valve mounted to be slidable in the hydraulic manifold to raise and lower the plow, the vehicle having a power source and a back-up light switch which is activated when the vehicle is placed in reverse, said plow lift system including:

an electrical means including a solenoid and a relay, the relay being connected in series with the back-up light switch of the vehicle having the plow control being modified to activate the relay when the back-up light switch is closed, the relay being connected to the solenoid to energize the solenoid, the electrical means further including a limit switch for deactivation of the solenoid when the plow is raised to its uppermost desired position;

a solenoid arm mounted in the solenoid that moves in the solenoid when the solenoid is electrically energized;

a pivot; and an actuator arm having two ends, the actuator arm being mounted on the pivot between the two ends, one end of the actuator arm being connected to the solenoid arm and the other end being connected to the valve in the plow control being modified.

2. A plow lift system according to claim 1 wherein the electrical means further includes an on-off switch connected in series with the back-up light switch for actuating and deactivating the electrical means.

3. A plow lift system for incorporation into and the modification of an existing snow plow control on a vehicle with a snow plow, the snow plow control having a hydraulic manifold with a valve mounted to be slidable in the hydraulic manifold to raise and lower the plow, the vehicle having a power source and a back-up light switch which is activated when the vehicle is placed in reverse, said plow lift system including:

an electrical means including a solenoid and a relay, the relay being connected in series with the back-up light switch of the vehicle with the plow control being modified to activate the relay when the back-up light switch is closed, the relay being connected to the solenoid to energize the solenoid, the electrical means further including a limit switch for deactivation of the solenoid when the plow is raised to its uppermost desired position and an on-off switch for actuating and deactivating the electrical means;

a solenoid arm mounted in the solenoid that withdraws into the solenoid when the solenoid is electrically energized;

a pivot; and an actuator arm having two ends, the actuator arm being mounted on the plivot between the two ends, one end of the actuator arm being connected to the solenoid arm and the other end being connected to the valve in the plow control being modified, the actuator arm pulling the valve when the solenoid arm is withdrawn into the solenoid.

* * * * *